US005850124A

United States Patent [19]

Hasegawa et al.

[11] Patent Number: 5,850,124

[45] Date of Patent: Dec. 15, 1998

[54] AUTOMOBILE LAMP BULB WITH WELDED LOW BEAM SHIELD

[75] Inventors: Toru Hasegawa; Hajime Tabata; Mutsumi Katayama, all of Saitama, Japan

[73] Assignee: Honda Giken Kogyo Kabushiki Kaisha, Tokyo, Japan

[21] Appl. No.: 868,988

[22] Filed: Jun. 4, 1997

[30] Foreign Application Priority Data

Jun. 4, 1996 [JP] Japan ..... 8-141889
Jun. 12, 1996 [JP] Japan ..... 8-151367

[51] Int. Cl.[6] ..... H01K 9/00

[52] U.S. Cl. ..... 313/578; 313/316; 313/113; 313/115

[58] Field of Search ..... 313/113, 115, 313/578, 579, 580, 316

[56] References Cited

U.S. PATENT DOCUMENTS

| | | | |
|---|---|---|---|
| 1,793,398 | 2/1931 | Hamberger | 313/579 |
| 3,774,064 | 11/1973 | Vause | 313/316 |
| 3,801,178 | 4/1974 | Van Den Berge . | |
| 3,824,421 | 7/1974 | Schuringa et al. . | |
| 3,904,908 | 9/1975 | Wolfe et al. | 313/271 |
| 3,912,961 | 10/1975 | Rees et al. | 313/223 |
| 4,801,845 | 1/1989 | Kiesel | 313/579 |

FOREIGN PATENT DOCUMENTS

| | | | |
|---|---|---|---|
| 566050 | 11/1958 | Canada | 313/316 |
| 2118061 | 4/1971 | Germany | 313/316 |
| 224445 A1 | 7/1985 | Germany . | |
| 3616673 A1 | 11/1987 | Germany . | |
| 64-2356 | 9/1989 | Japan . | |
| 1313532 | 4/1970 | United Kingdom . | |
| 1313531 | 4/1973 | United Kingdom | 313/316 |

OTHER PUBLICATIONS

European Patent Application No. 97 108 901.6; Honda Giken Kogyo K.K.

*Primary Examiner*—Sandra O'Shea
*Assistant Examiner*—Matthew J. Gerike
*Attorney, Agent, or Firm*—Birch, Stewart, Kolasch & Birch, LLP

[57] ABSTRACT

In an automobile lamp bulb, a shield is attached firmly to a common conductor by an improved fixing method. Dents are formed in one surface of a shield to form projections in the other surface of the same and a cut is formed in the shield. Portions of the shield defined by the cut are raised to form lugs, and projections are formed, respectively, on the lugs. A projection is formed in each lug which corresponds to the dents, but project in opposite directions. The projections of the shield are welded by projection welding to the common conductor to join the shield firmly to the common conductor. Therefore, an inexpensive rough service automobile lamp bulb is provided. In another embodiment, a portion of a round common conductor is flattened to form a flat portion. A shield is positioned on and welded to the flat portion of the common conductor. Since the shield is positioned on and welded to the common conductor in surface contact, the amplitude of vibration of the shield can effectively be suppressed.

17 Claims, 16 Drawing Sheets

AUTOMOBILE LAMP BULB WITH WELDED LOW BEAM SHIELD

BACKGROUND OF THE INVENTION

1. Field of the Invention

The present invention relates to a rough service automobile lamp bulb designed for active use.

2. Background Art

FIG. 8 illustrates a conventional automobile lamp bulb 1100 of the so-called H4 type in a side view. The automobile lamp bulb 1100 comprises a glass bulb 1101, a base 1102 closing the open end of the glass bulb 1101, a common conductor 1103, a cup-shaped shield 1104 welded to an upper portion of the common conductor 1103, a low beam filament 1105 disposed along the shield 1104, a conductor 1106 for the low beam filament 1105, a high beam filament 1107 disposed below the shield 1104, a conductor 1108 for the high beam filament 1107 and a reinforcing bridge 1109. Halogen gas is sealed in the glass bulb 1101. The low beam filament 1105 has one end connected to a clip 1105*a*fixed to the conductor 1106 and the other end connected to a chip 1105*b*fixed to the shield 1104.

The three conductors 1103, 1106 and 1108 are held on the base 1102 in a cantilever fashion and project from the base 1102. Therefore, when vibrations are transmitted to the conductors 1103, 1106 and 1108, the free ends, i.e., the upper ends, of the conductors 1103, 1106 and 1108 vibrate in great amplitudes. Since the shield 1104 is at a relatively long distance from the base 1102, the shield 1104 tends to vibrate in a great amplitude. Therefore, the shield 1104 vibrates with a delay relative to the vibration of the common conductor 1103, the amplitude of its vibration increases, and an increased stress is induced in the low beam filament 1105 disposed along the shield 1104 to reduce the life of the low beam filament 1105 unless the shield 1104 is welded firmly to the common conductor 1103. A lamp bulb proposed in JP-U No.64-2356 will be described hereinafter.

FIG. 9 illustrates a conventional automobile lamp bulb 1110 in a side view. The automobile lamp bulb 1110 comprises a glass bulb 1111, a base 1112 closing the open end of the glass bulb 1111, a common conductor 1113 having an upper portion reaching to a neck portion 1111*a*of the glass bulb 1111, a cup-shaped shield 1114 welded to a portion of the common conductor 1113, a low beam filament 1115 disposed along the shield 1114, a conductor 1116 for the low beam filament 1115, a high beam filament 1117 disposed below the shield 1114, a conductor 1118 for the high beam filament 1117 and a reinforcing bridge 1119. Halogen gas is sealed in the glass bulb 1111. The low beam filament 1115 has one end connected to a clip 1115*a*fixed to the conductor 1116 and the other end connected to a chip 1115*b*fixed to the shield 1114.

The common conductor 1113 is held fixedly at both ends, i.e., at its lower end by the base 1112 and at its upper end by the neck 1111*a*of the glass bulb 1111. Therefore, the deflection of the common conductor 1113 is far less than that of a common conductor held in a cantilever fashion, and the amplitude of vibration of the common conductor 1113 is smaller than that of a common conductor held in a cantilever fashion. Consequently, the common conductor 1113 which is held at both ends has a remarkably extended life for the low beam filament 1115.

Therefore, the lamp bulb 1110 having the common conductor 1113 having an upper portion fixed to the glass bulb 1111 is called a rough service or active use automobile lamp bulb.

FIG. 10 is a sectional view taken on line 10—10 in FIG. 9. The cup-shaped shield 1114 is fixed to the common conductor 1113 by projection welding. More specifically, projections are formed in the metal shield 1114 so as to project to the right as viewed in FIG. 10, the projections are placed on the common conductor 1113, and an electric current is supplied through the shield 1114 and the common conductor 1113 to generate Joule heat locally in the projections so that the projections are welded to the common conductor 1113.

When vibrations are transmitted to the shield 1114, it is possible that the shield 114 swings on the welds 1121 in the directions of the arrows, thus causing the low beam filament 1115 having one end attached to the conductor 1116 and the other end attached to the shield 1114 to vibrate.

SUMMARY AND OBJECTS OF THE INVENTION

Accordingly, it is an object of the present invention to fix a shield securely to a common conductor by an improved shield fixing method.

According to the present invention, a plurality of lugs are formed on a shield by raising portions of the shield, a common conductor is held between the lugs and the lugs are welded to the common conductor.

Since the lugs are welded to the common conductor, the number of weld points is increased, and the shield can be firmly attached to the common conductor.

According to the present invention, a shield has a cuplike body and a tongue extending upwardly from the upper edge of the cuplike body, the tongue is provided in its upper portion with a common conductor holding recess, the common conductor is held in the common conductor holding recess, and the shield is welded to the common conductor.

Since the common conductor is held in the common conductor holding recess of the tongue, the amplitude of vibration of the shield can be suppressed.

Since the lug of the tongue is welded to the common conductor, the amplitude of vibration of the shield can be suppressed, the number of weld points is increased to attach the shield firmly to the common conductor.

According to the present invention, the extremity of the common conductor is joined to the glass bulb.

Since the common conductor is held at both ends, the deflection of the common conductor is very small, the amplitude of vibration of the shield is small and hence the life of the automobile lamp bulb can be extended.

When vibrations are transmitted to the shield, it is possible that the shield will swing on the welds, causing the low beam filament having one end attached to the conductor and the other end attached to the shield to vibrate.

According to the present invention, a flat portion is formed in a common conductor by flattening a portion of the common conductor by plastic working, and a shield is positioned on and welded to the flat portion of the common conductor.

Since the shield is positioned on the common conductor in surface contact instead of conventional point contact, the shield can securely be attached to the common conductor and the amplitude of vibration of the shield can be suppressed.

According to the present invention, a shield has a cuplike body and a tongue extending upwardly from the upper edge of the cuplike body, the tongue is provided in its upper portion with a common conductor holding recess, a common conductor is held in the common conductor holding recess, a flat portion is formed in the common conductor by flattening a portion of the common conductor by plastic working, and the shield is positioned on and welded to the flat portion of the common conductor.

Even if the rigidity of the common conductor is reduced by the formation of the flat portion, the reduction of the rigidity is compensated by the agency of the common conductor holding recess, so that the common conductor has sufficient rigidity.

According to the present invention, a shield has a cuplike body and a tongue extending upwardly from the upper edge of the cuplike body, a portion of the tongue is bent toward a common conductor to form a lug, the lug is welded to the common conductor, a flat portion is formed in the common conductor by flattening a portion of the common conductor by plastic working, and the shield is positioned on and welded to the flat portion of the common conductor.

Since the lug and the cuplike body of the shield are welded to the common conductor, the amplitude of vibration of the shield can be suppressed.

Since the shield is positioned on the common conductor in surface contact instead of conventional point contact, the shield can securely be attached to the common conductor and the amplitude of vibration of the shield can be suppressed.

Even if the rigidity of the common conductor is reduced by the formation of the flat portion, the reduction of the rigidity is compensated by the lug, so that the common conductor has sufficient rigidity.

According to the present invention, a shield has a cuplike body and a tongue extending upwardly from the upper edge of the cuplike body, a portion of the tongue is bent toward a common conductor to form a lug, the lug is welded to the common conductor, and the cuplike portion is welded to the common conductor.

Since the lug and the cuplike body of the shield are welded to the common conductor, the additive effect of the respective rigidities of the shield and the common conductor suppresses the amplitude of vibration of the shield. Since the plastic working for flattening a portion of the common conductor is unnecessary, the manufacturing cost can be reduced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Preferred embodiments of the present invention will be described hereinafter with reference to the accompanying drawings.

Figure 1:
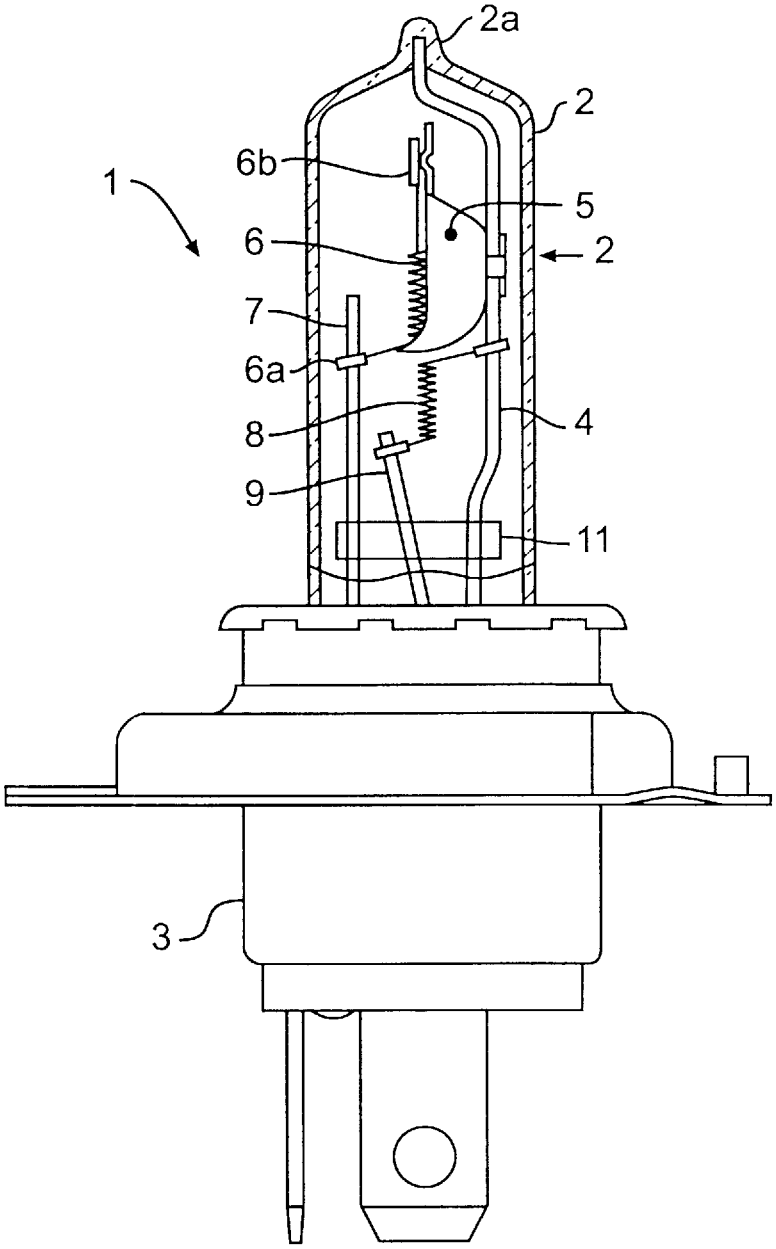
FIG. 1 is a side view of an automobile lamp bulb in a first embodiment according to the present invention.

FIG. 1 illustrates an essential portion of an automobile lamp bulb 1 in a first embodiment according to the present invention in a side view. The automobile lamp bulb 1 comprises a glass bulb 2, a base 3 closing the open end of the glass bulb 2 and a common conductor 4 having an extremity reaching to a neck 2*a* formed in the glass bulb 2. A cup-shaped shield 5 is welded to a portion of the common conductor 4. A low beam filament 6 is disposed along the shield 5. A conductor 7 is provided for the low beam filament 6. A high beam filament 8 is disposed below the shield 5. A conductor 9 is provided for the high beam filament 8. A reinforcing bridge 11 is connected at the lower ends of the conductors 4, 7 and 9. Halogen gas is sealed in the glass bulb 2. The low beam filament 6 has one end connected to a clip 6*b* fixed to the shield 5 and the other end connected to a clip 6*a* fixed to the conductor 7.

When the high beam filament 8 is selected, a current flows through the conductor 9, the high beam filament 8 and the common conductor 4 (or in the reverse direction) to make the high beam filament emit light.

When the low beam filament 6 is selected, a current flows from the conductor 7 through the low beam filament 6, the shield 5 and the common conductor 4 (or in the reverse direction) to make the low beam filament 6 emit light. Although the original function of the shield 5 is to screen part of the light emitted by the filament 6, one end of the filament 6 is connected to the shield 5 because the shield 5 is made of a metal.

Figure 2:
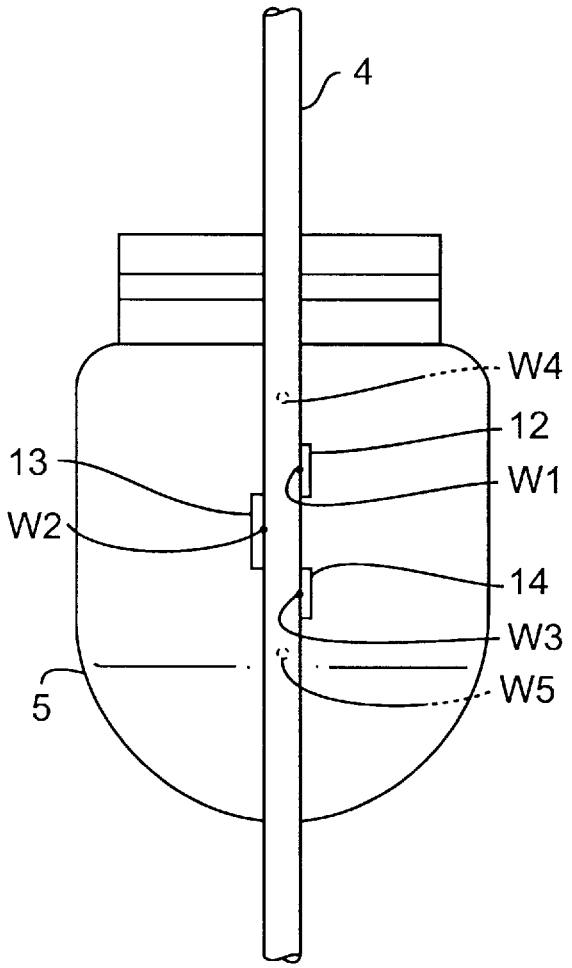
FIG. 2 is a view taken in the direction of the arrow 2 in FIG. 1.

FIG. 2 is a view taken in the direction of the arrow 2 in FIG. 1. Lugs 12, 13 and 14 are formed in the shield 5 by raising portions of the shield 5, and the lugs 12, 13 and 14 are welded to the common conductor 4 by weld spots W1, W2 and W3. Thus, the shield 5 is joined to the common conductor 4 at five points, i.e., the weld spots W1, W2 and W3, and additional weld spots W4 and W5. The weld spots W4 and W5 are on a surface of the common conductor 4 in contact with the shield 5, the weld spots W1 and W3 are on the right side, as viewed in FIG. 2, of the common conductor 4, and the weld spot W2 is on the left side, as viewed in FIG. 2, of the common conductor 4.

A method of fabricating the automobile lamp bulb in the first embodiment will be described hereinafter.

Figure 3A:
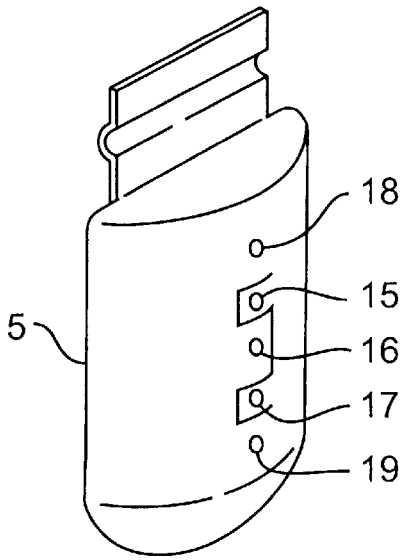
FIGS. 3(*a*), 3(*b*) and 3(*c*) are views to assist in explaining a method of fabricating the first embodiment.
Figure 3B:
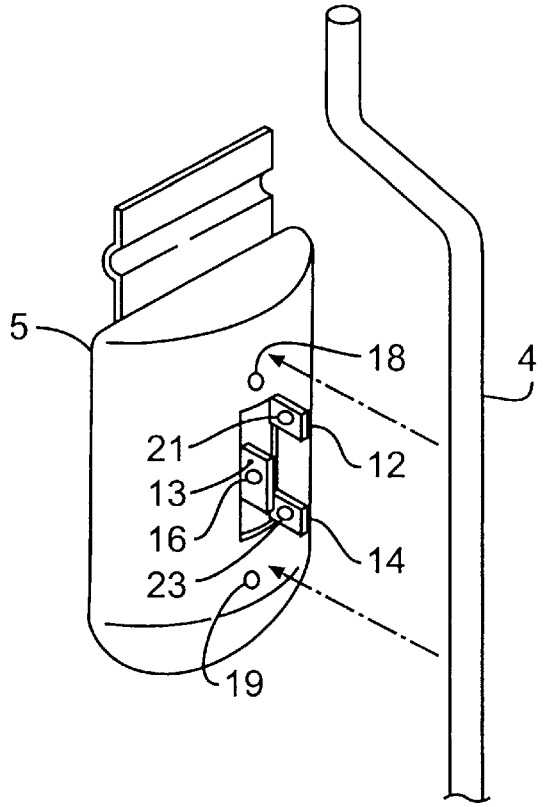
Figure 3C:
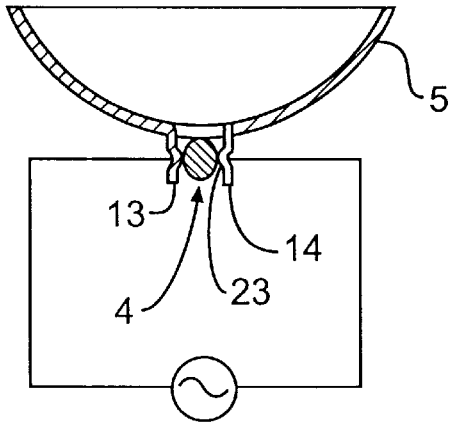

FIGS. 3(*a*) to 3(*c*) are views to assist in explaining the method of fabricating the first embodiment. Referring to FIG. 3(*a*), dents 15, 16 and 17 (which are formed in one surface of the shield 5 to form projections in the outer surface of the same), projections 18 and 19, and a cut are formed in the shield 5.

Referring to FIG. 3(*b*), portions of the shield 5 defined by the cut are raised to form the lugs 12, 13 and 14. Projections 21 and 23 are formed respectively on the lugs 12 and 14. A projection (which does not appear in FIG. 3(*b*)) is formed in the lug 13 and corresponds to the dent 16 and projects in the direction, respectively. The common conductor 4 is moved in the direction of the arrows toward the shield 5 to combine the common conductor 4 with the shield 5.

Referring to FIG. 3(*c*), the projections of the shield 5 are welded by projection welding to the common conductor 4 to join the shield 5 firmly to the common conductor 4 as shown in FIG. 2. A welding circuit is shown by way of example in FIG. 3(*c*)

Figure 4:
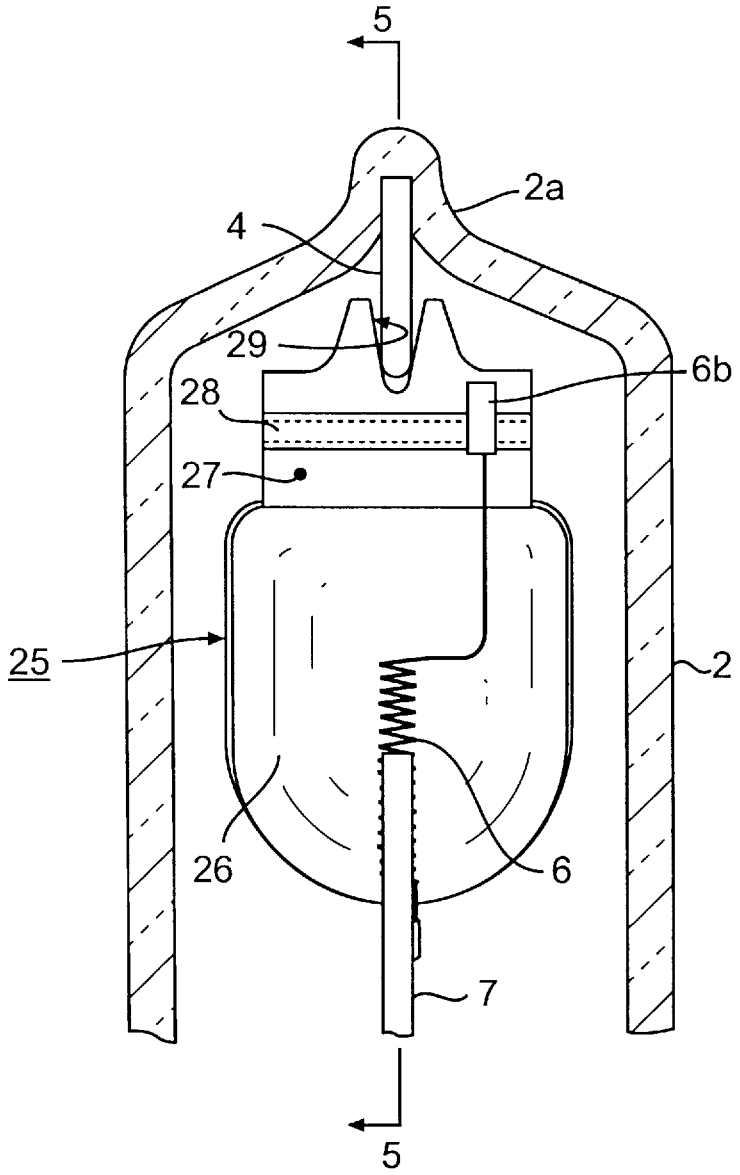
FIG. 4 is a front view of an essential portion of an automobile lamp bulb in a second embodiment according to the present invention.

FIG. 4 illustrates an essential portion of an automobile lamp bulb in a second embodiment according to the present invention in a front view. The automobile lamp bulb is provided with a shield 25 having a cuplike body 26 and a tongue 27 extending from the upper end of the cuplike body 26. The tongue 27 is provided with a rib 28 and a V-shaped recess 29. One end of a low beam filament 6 is attached to a clip 6*b* fixed to the rib 28 of the shield 25.

Figure 5:
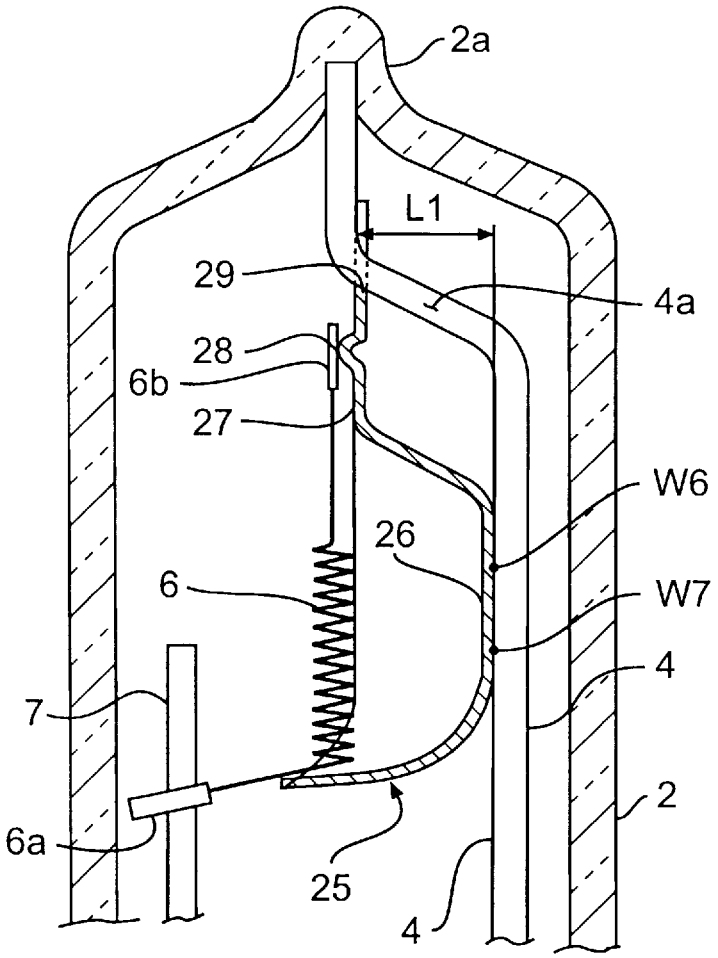
FIG. 5 is a sectional view taken on line 5—5 in FIG. 4.

FIG. 5 is a sectional view taken on line 15—15 in FIG. 4. As illustrated in FIG. 5, a glass bulb 2 is provided together with a common conductor 4, the shield 25, the low beam filament 6, and a conductor 7 for the low beam filament 6.

The cuplike body of the shield 25 is welded to the common conductor 4 by weld spots W6 and W7. A bend in an S-shaped portion 4a of the common conductor 4 is received and secured in the V-shaped recess 29.

Although there is a tendency for the shield 25 to turn relative to the common conductor 4 on the weld spots W6 and W7, the shield 25 is unable to turn because the common conductor 4 received in the V-shaped recess 29 is in engagement with the shield 25. Since the V-shaped recess 29 is spaced a distance L1 from a point about which the shield 25 tries to turn, the amplitude of vibration of the shield 25 can effectively be suppressed.

Figure 6A:
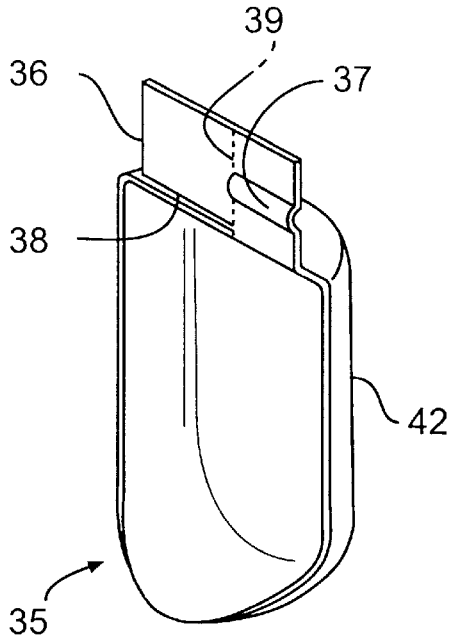
FIGS. 6(*a*), 6(*b*) and 6(*c*) are views to assist in explaining a method of fabricating an automobile lamp bulb in a third embodiment according to the present invention.
Figure 6B:
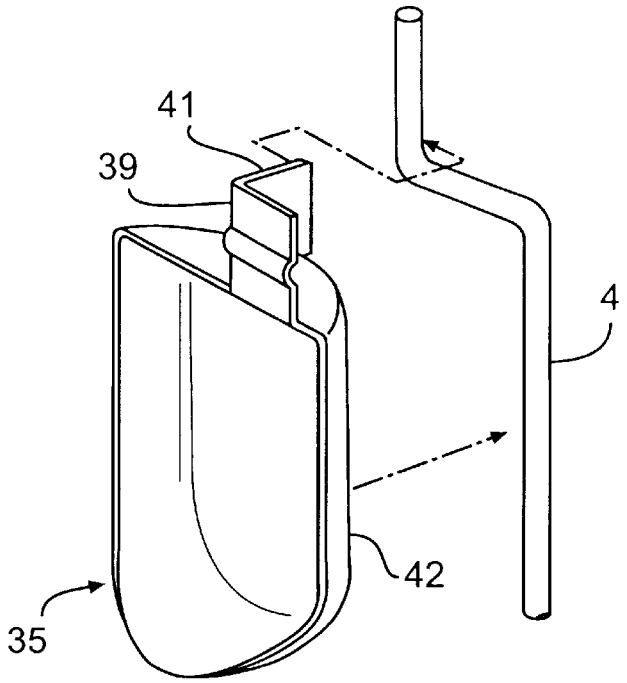
Figure 6C:
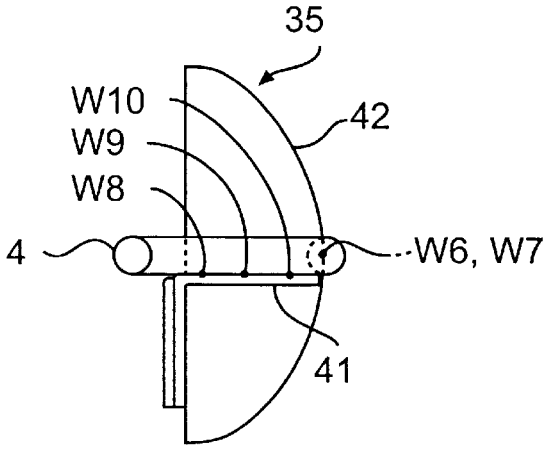

FIGS. 6(*a*) to 6(*c*) are views to assist in explaining a method of fabricating an essential portion of an automobile lamp bulb in a third embodiment according to the present invention.

As illustrated in FIG. 6(*a*), a relatively short rib 37 is formed in a tongue 36 of a shield 35, and a relatively long cut 38 is formed in a base portion of the tongue 36. Broken line 39, as illustrated in FIG. 6(*a*) is a folding line.

As shown in FIG. 6(*b*), a left portion, as viewed from the concave side of the shield 35, of the tongue 36 is bent toward the convex side of the shield 35 to form a lug 41. The lug 41 and a cuplike body 42 are positioned on a common conductor 4. The cuplike body 42 is provided with projections, not shown, for projection welding.

As shown in FIG. 6(*c*), the cuplike body 42 of the shield 35 is welded by weld spots W6 and W7 to the common conductor 4, and the lug 41 is welded to the common conductor 4 by weld spots W8, W9 and W10.

Figure 7:
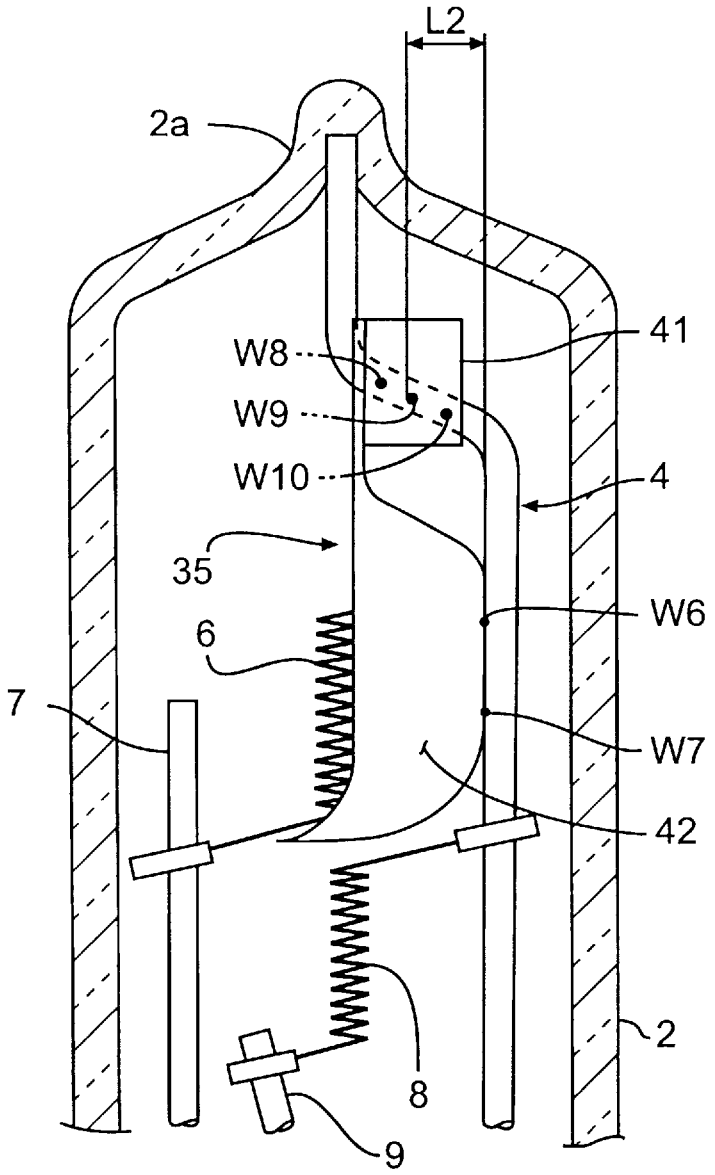
FIG. 7 is a side view of an essential portion of the automobile lamp bulb in the third embodiment.

FIG. 7 is a side view of an essential portion of the automobile lamp bulb of the third embodiment. The shield 35 is welded to the common conductor 4 by the weld spots W8 to W10.

Although the shield 35 tries to turn relative to the common conductor 4 on the weld spots W8 and W7, the shield 35 is unable to turn because the lug 41 is welded to the common conductor 4. Since the lug 41 is spaced a distance L2 apart from a point about which the shield 35 tries to turn, the amplitude of vibration of the shield 35 can effectively be suppressed.

Features of the first, the second and the third embodiment may be used in combination.

Figure 8:
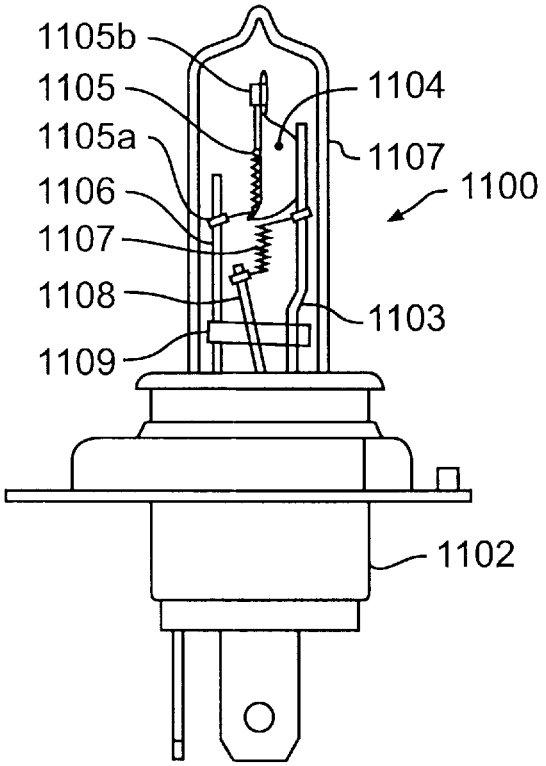
FIG. 8 PRIOR ART
FIG. 8 is a side view of a conventional automobile lamp bulb.
Figure 9:
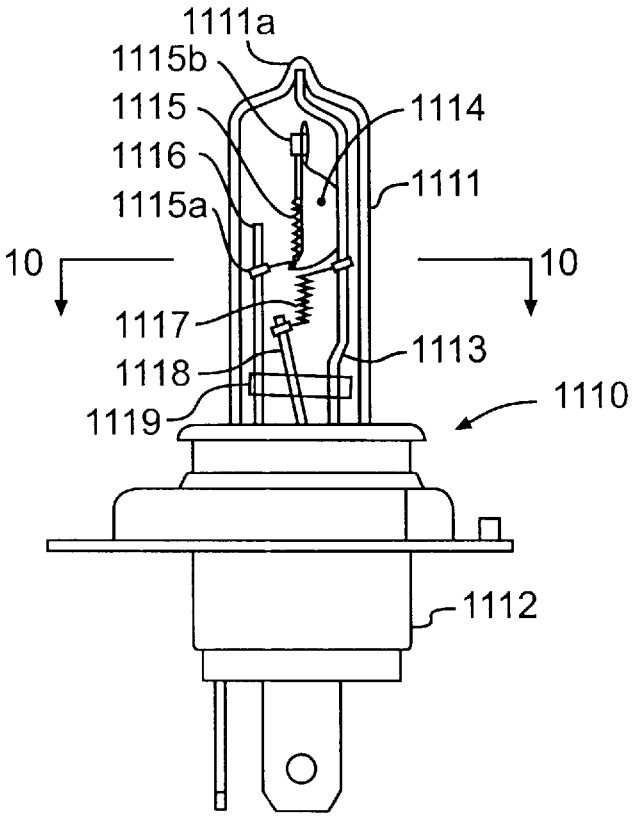
FIG. 9 PRIOR ART
FIG. 9 is a side view of a conventional rough service or active use automobile lamp bulb.
Figure 10:
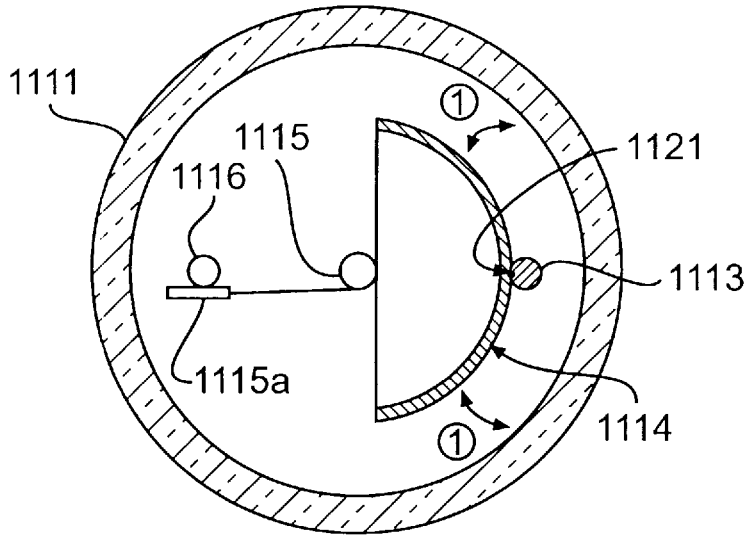
FIG. 10 PRIOR ART
FIG. 10 is a sectional view taken on line 10—10 in FIG. 9.

Although the present invention is effective when applied to a rough service or active use lamp bulb provided with a common conductor 4 having an extremity joined to a glass bulb 2, such as shown in FIG. 9, the present invention is applicable to an ordinary lamp bulb as shown in FIG. 8. The recess 29 may be either a V-shaped recess or a U-shaped recess.

Figure 11:
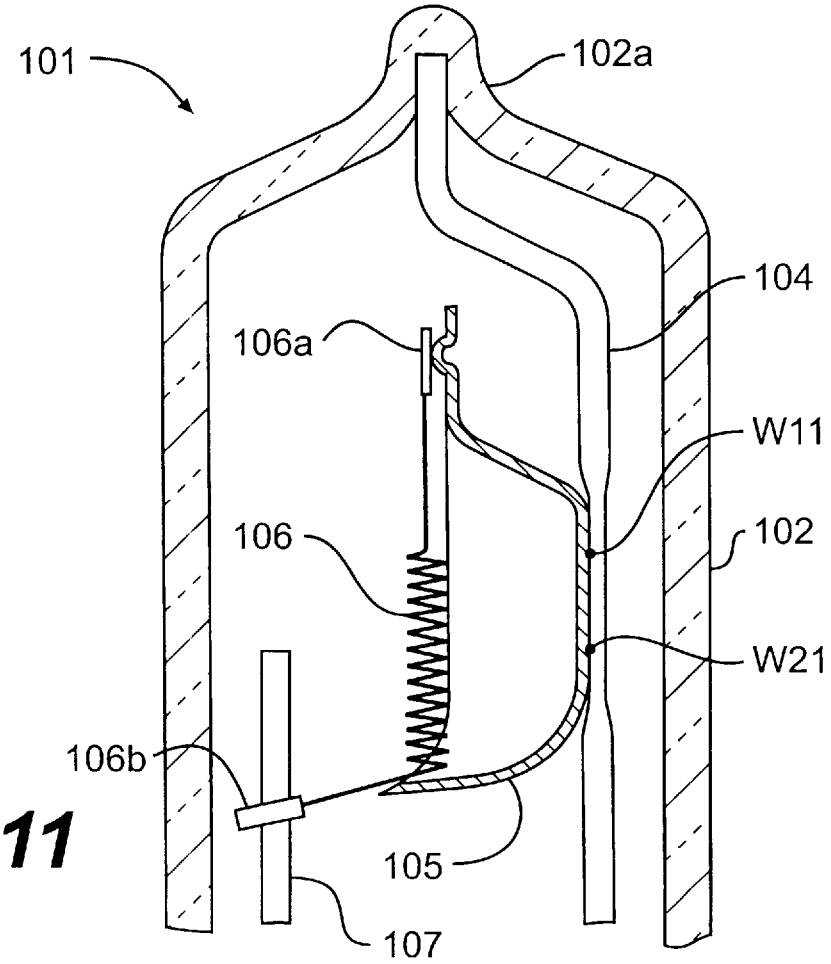
FIG. 11 is a side view of an essential portion of an automobile lamp bulb in a fourth embodiment according to the present invention.

FIG. 11 illustrates an essential portion of an automobile lamp bulb 101 in a fourth embodiment according to the present invention in a fragmentary side view. The automobile lamp bulb 101 comprises a glass bulb 102, a common conductor 104, a shield 105, a low beam filament 106 and conductor 107 for the low beam filament 106. The low beam filament 106 has one end 106*a* welded to an upper portion of the shield 105 and the other end 106*b* welded to the conductor 107. The shield 105 is welded to the common conductor 104 by weld spots W11 and W21. The upper end portion of the common conductor 104 is held in a neck 102*a* formed in the glass bulb 102.

Figure 12:
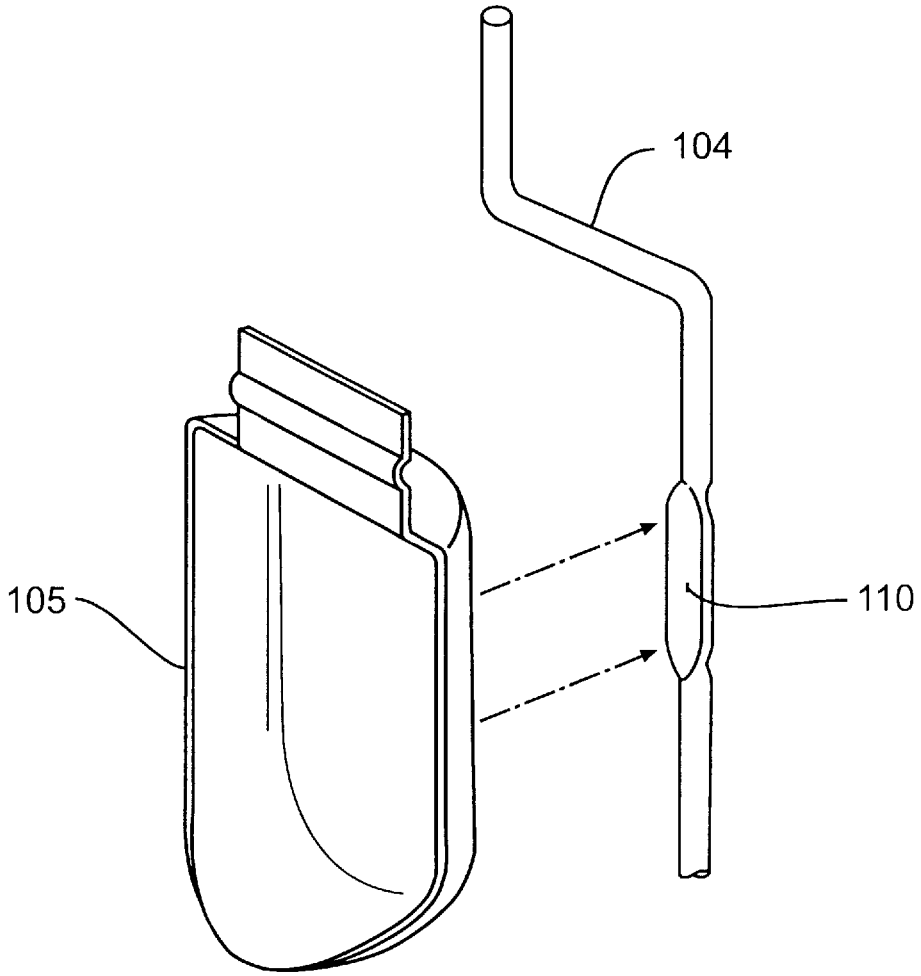
FIG. 12 is an exploded perspective view of an essential portion of the automobile lamp bulb in the fourth embodiment according to the present invention.

FIG. 12 is an exploded perspective view of an essential portion of the automobile lamp bulb in the fourth embodiment. A flat portion 110 is formed in a portion of the common conductor 104 by plastic working.

Figure 13C:
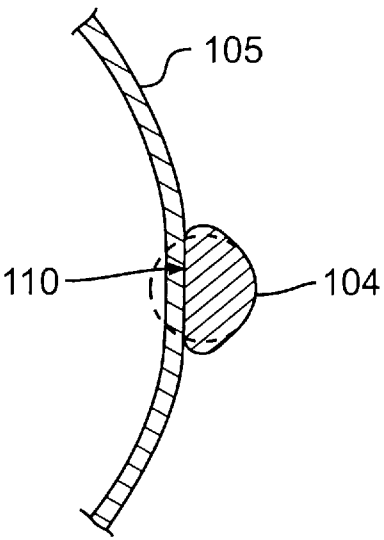
FIGS. 13(*a*), 13(*b*) and 13(*c*) are sectional views of flat portions of common conductors in accordance with the present invention.
Figure 13B:
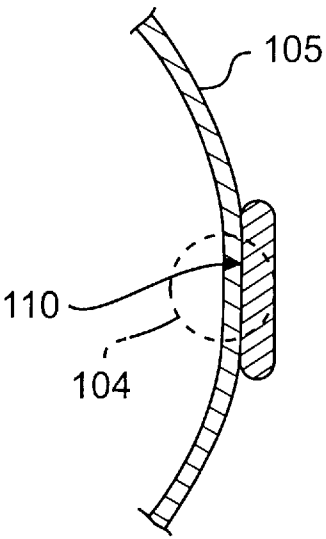
Figure 13A:
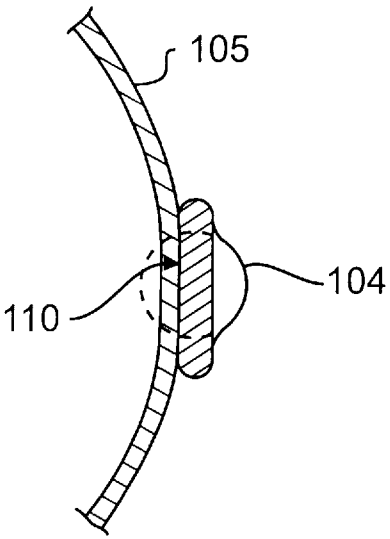

FIGS. 13(*a*) to 13(*c*) are sectional views of flat portions formed in common conductors in accordance with the present invention.

FIG. 13(*a*) shows a flat portion 110 formed by flattening diametrical opposite sides of a portion of a round common conductor 104. The flat portion 110 has a large area in contact with the shield 105, so that the shield 105 is difficult to vibrate at a higher amplitude.

FIG. 13(*b*) shows a flat portion 110 formed by flattening one side of a portion of a round common conductor. The flat portion 110 has a large area in contact with the shield 105, so that the shield 105 is difficult to vibrate at a higher amplitude.

FIG. 13(*c*) shows a flat portion 110 having a substantially T-shaped cross section formed by flattening one side of a portion of a round common conductor. Although the width of the flat portion 110 is relatively small, the large sectional area of the flat portion 110 secures a high rigidity of the common conductor.

A die for forming the flat portion shown in FIG. 13(*a*) is simple and the flat portion can easily be formed because the flat portion has a center. A die for forming the flat portion shown in FIG. 13(*b*) is somewhat complicated because the flat portion is eccentric.

Since the shield is positioned on the common conductor in surface contact instead of point contact with the common conductor, the shield can firmly be attached to the common conductor and the amplitude of vibration of the shield can be suppressed.

Figure 14:
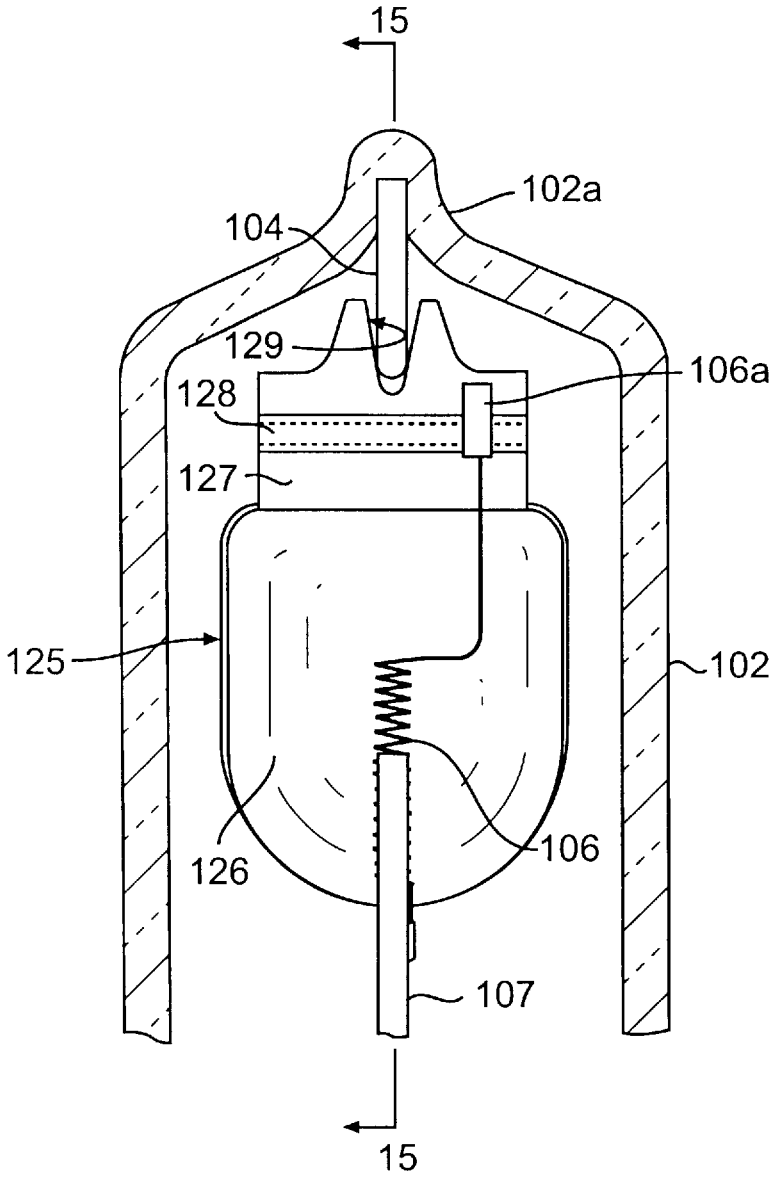
FIG. 14 is a front view of an essential portion of an automobile lamp bulb in a fifth embodiment according to the present invention.

FIG. 14 illustrates a front view of an essential portion of an automobile lamp bulb in a fifth embodiment according to the present invention. The automobile lamp bulb is provided with a shield 125 having a cuplike body 126 and a tongue 127 extending from the upper end of the cuplike body 126. The tongue 127 is provided with a rib 128 and a V-shaped recess 129. One end 106*a* of a low beam filament 106 is attached to the rib 128 of the shield 125.

Figure 15:
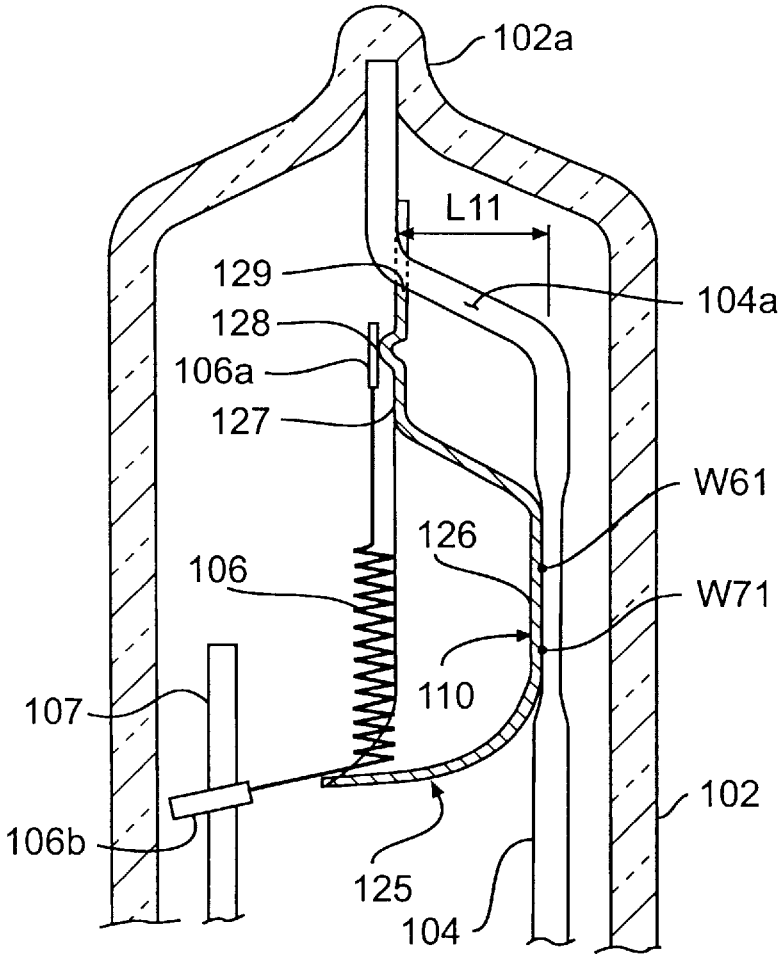
FIG. 15 is a sectional view taken on line 15—15 in FIG. 4.

FIG. 15 is a sectional view taken on line 15—15 in FIG. 14. A glass bulb 102 is provided together with a common conductor 104, the shield 125, the low beam filament 106, and a conductor 107 for the low beam filament 106. The common conductor 104 is provided with a flat portion 110.

The cuplike body of the shield 125 is welded to the common conductor 104 by weld spots W61 and W71. A bend in an S-shaped portion of the common conductor 104 is received and secured in the V-shaped recess 129.

Although the shield 125 tries to turn relative to the common conductor 104 on the weld spots W61 and W71, the shield 125 is unable to turn because the bend of the S-shaped portion 104*a* of the common conductor received in the V-shaped recess 129 is in engagement with the shield 125. Since the V-shaped recess 129 is spaced a distance L11 from a point about which the shield 125 tries to turn, the amplitude of vibration of the shield 125 can effectively be suppressed.

Moreover, since the shield is positioned on the common conductor in surface contact instead of point contact with the common conductor, the shield can firmly be attached to the common conductor and the amplitude of vibration of the shield can be suppressed.

Even if the rigidity of the common conductor 104 is reduced by the formation of the flat portion, the reduction in the rigidity is compensated by the agency of the V-shaped recess 129, so that the common conductor has sufficient rigidity.

Figure 16A:
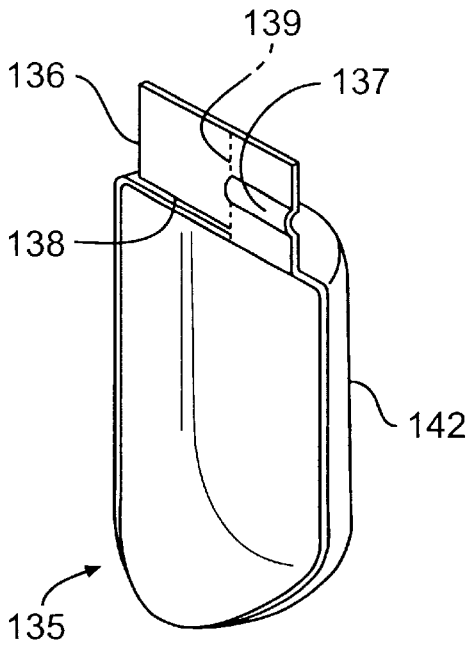
FIGS. 16(*a*), 16(*b*) and 16(*c*) are views to assist in explaining a method of fabricating an essential portion of an automobile lamp bulb in a sixth embodiment according to the present invention.
Figure 16B:
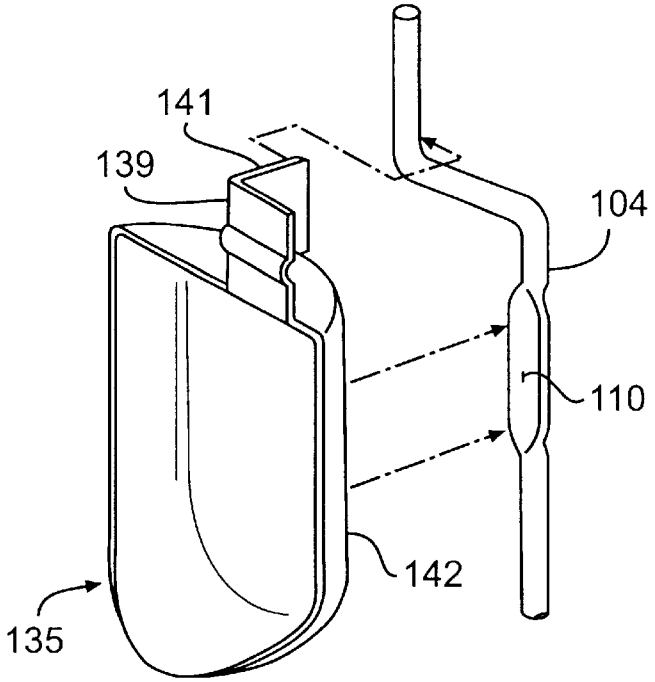
Figure 16C:
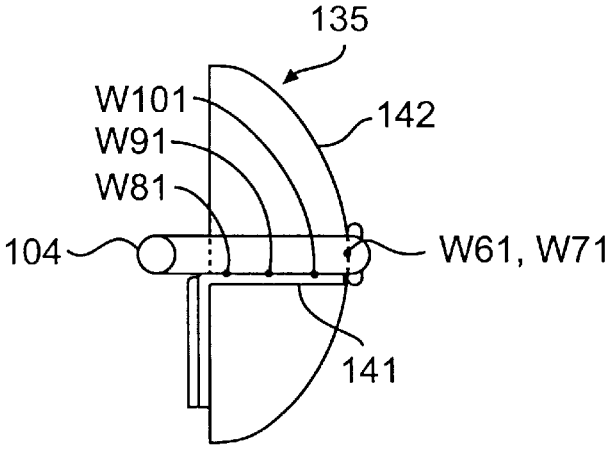

FIGS. 16(*a*) to 16(*c*) are views to assist in explaining a method for fabricating an essential portion of an automobile lamp bulb according to a sixth embodiment of the present-invention.

As shown in FIG. 16(*a*), a relatively short rib 137 is formed in a tongue 136 of a shield 135, and a relatively long cut 138 is formed in a base portion of the tongue 136. The broken line 139 in FIG. 16(*a*), indicates a folding line.

As shown in FIG. 16(*b*), a left portion, as viewed from the concave side of the shield 135, of the tongue 136 is bent toward the convex side of the shield 135 to form a lug 141. The lug 141 and a cuplike body 142 are positioned on a common conductor 104. The cuplike body 142 is provided with projections, not shown, for projection welding.

As shown in FIG. 16(*c*), the cuplike body 142 of the shield 135 is welded by weld spots W61 and W71 to the common conductor 104, and the lug 141 is welded to the common conductor 104 by weld spots W81, W91 and W101.

Figure 17:
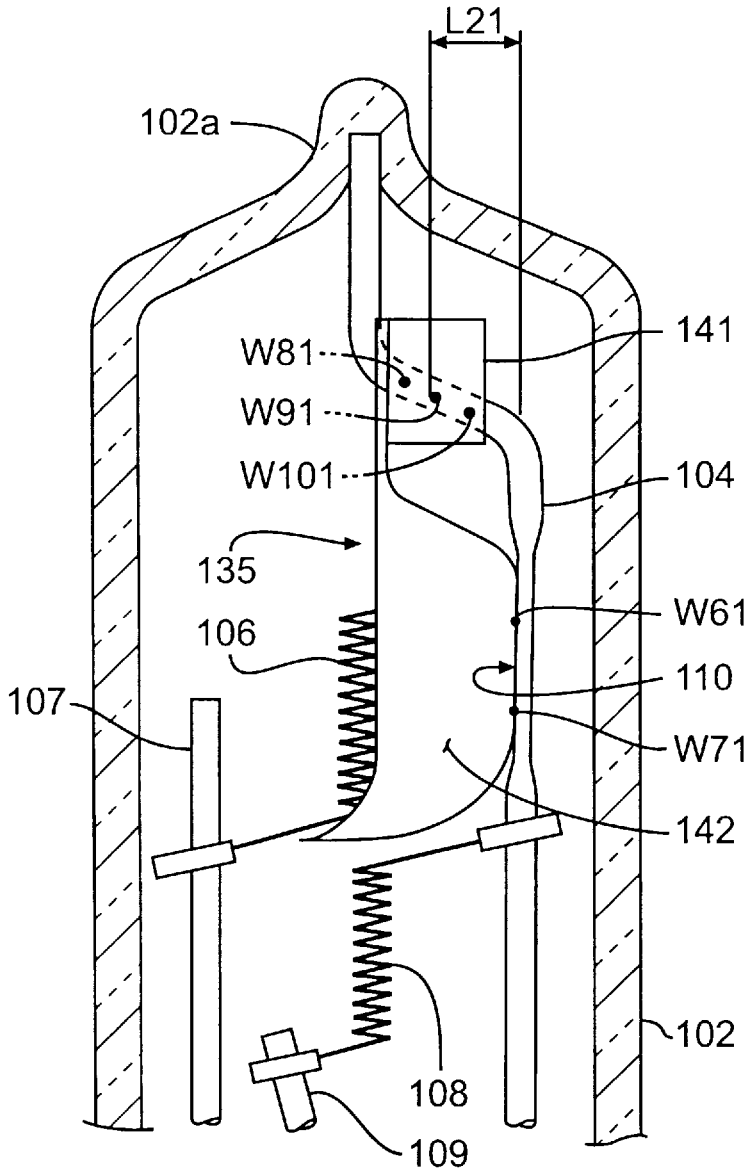
FIG. 17 is a side view of an essential portion of the automobile lamp bulb in the sixth embodiment.

FIG. 17 is a side view of an essential portion of the automobile lamp bulb in the sixth embodiment. The shield 135 is welded to the common conductor 104 by the weld spots W81 to W101. The common conductor 104 has a flat portion 110.

Although the shield 135 tries to turn relative to the common conductor 104 on the weld spots W81 and W71, the shield 135 is unable to turn because the lug 141 is welded to the common conductor 104. Since the lug 141 is spaced a distance L21 apart from a point about which the shield 135 tries to turn, the amplitude of vibration of the shield 135 can effectively be suppressed.

Moreover, since the shield is positioned on the common conductor in surface contact instead of point contact with the common conductor, the shield can firmly be attached to the common conductor and the amplitude of vibration of the shield can be suppressed.

Even if the rigidity of the common conductor 104 is reduced by the formation of the flat portion, the reduction of the rigidity is compensated by the agency of the lug 141, so that the common conductor has sufficient rigidity.

Figure 18:
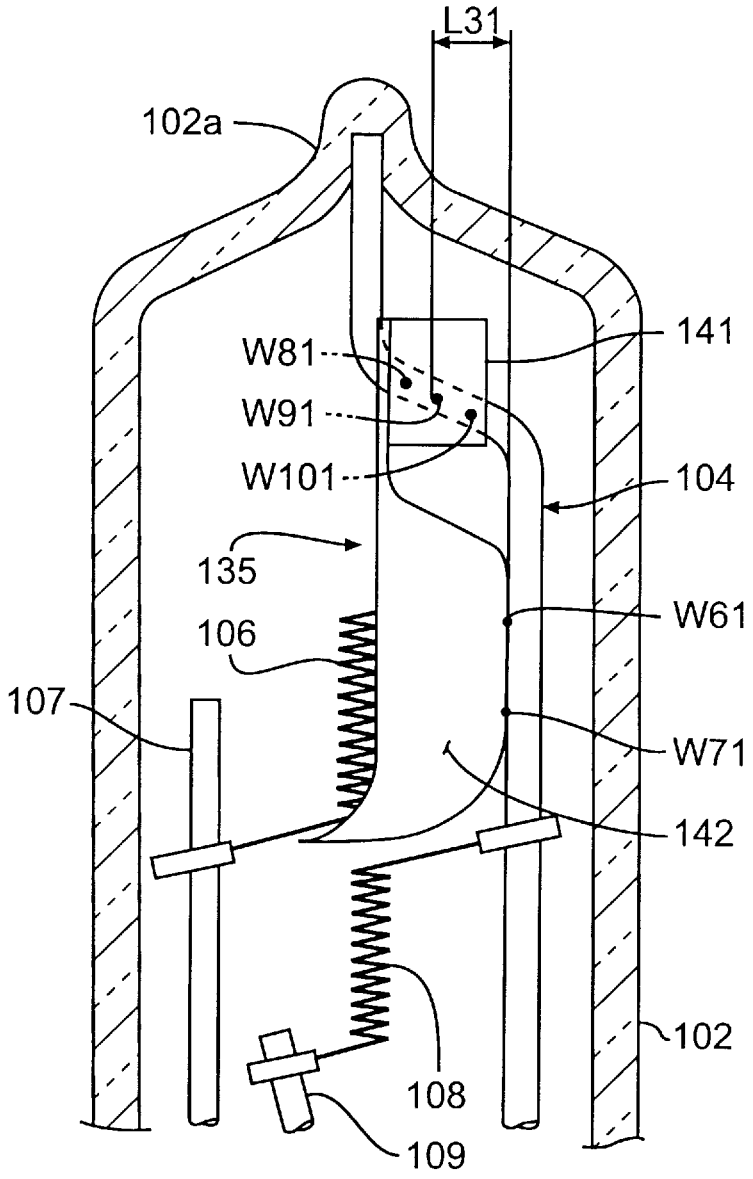
FIG. 18 is a side view of an essential portion of an automobile lamp bulb in a seventh embodiment according to the present invention.

FIG. 18 is a side view of an essential portion of an automobile lamp bulb in a seventh embodiment according to the present invention. A shield 135 is welded to a common conductor 104 by weld spots W81 to W101.

Although the shield 35 tries to turn relative to the common conductor 104 on the weld spots W81 and W91, the shield 135 is unable to turn because the lug 141 is welded to the common conductor 104. The lug 141 spaced a distance L31 apart from the a point about which the shield 135 tries to turn suppresses the amplitude of vibration of the shield 135 effectively.

Both the lug 141 and the cuplike body of the shield 135 are welded to the common conductor, the additive effect of the respective rigidities of the shield and the common conductor suppresses the amplitude of vibration of the shield effectively. Since the common conductor 104 requires a fewer number of working steps as compared to the common conductor of the sixth embodiment, the common conductor 104 of the seventh embodiment is less expensive than that of the third embodiment.

Although the present invention is effective when applied to a rough service or lamp bulb such as shown in FIG. 9, the present invention is applicable to an ordinary light bulb as shown in FIG. 8. The recess 129 may be either a V-shaped recess or a U-shaped recess.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An automobile lamp bulb comprising:

a common conductor;

a low beam filament;

a conductor for the low beam filament;

a high be filament;

a conductor for the high beam filament;

a shield disposed beside the low beam filament and welded to the common conductor;

a glass bulb containing the common conductor, the low beam filament, the conductor for the low beam filament, the high beam filament, the conductor for the high beam filament and the shield; and a plurality of lugs being formed on the shield said lugs being formed by raised portions of the shield, the common conductor being held between and welded to the lugs.

2. An automobile lamp bulb comprising:

a common conductor;

a low beam filament;

a conductor for the low beam filament;

a high beam filament;

a conductor for the high beam filament;

a shield disposed beside the low beam filament and welded to the common conductor;

a glass bulb containing the common conductor, the low beam filament, the conductor for the low beam filament, the high beam filament, the conductor for the high beam filament and the shield; and the shield includes a cup-like body and a tongue extending upwardly from an upper edge of the cup-like body, the tongue including an upper portion having a common conductor holding recess, the recess having first and second edges, the common conductor being held in the common conductor holding recess, and the first and second edges are welded to the common conductor.

3. An automobile lamp bulb comprising:

a common conductor;

a low beam filament;

a conductor for the low beam filament;

a high beam filament;

a conductor for the high beam filament;

a shield disposed beside the low beam filament and welded to the common conductor;

a glass bulb containing the common conductor, the low beam filament, the conductor for the low beam filament, the high beam filament, the conductor for the high beam filament and the shield; and the shield includes a cup-like body and a tongue extending upwardly from an upper edge of the cup-like body in a first direction, a portion of the tongue being bent towards the common conductor in a second direction generally perpendicular to the first direction to form a lug, the lug is welded to the common conductor, and the cup-like body of the shield is welded to the common conductor.

4. The automobile lamp bulb according to claim 1, wherein the extremity of the common conductor is joined to the glass bulb.

5. The automobile lamp bulb according to claim 2, wherein the extremity of the common conductor is joined to the glass bulb.

6. The automobile lamp bulb according to claim 3, wherein the extremity of the common conductor is joined to the glass bulb.

7. an automobile lamp bulb comprising:

a common conductor having a circular cross-section;

a low beam filament;

a conductor for the low beam filament;

a high beam filament;

a conductor for the high beam filament;

a shield disposed beside the low beam filament and welded to the common conductor;

a glass bulb containing the common conductor, the low beam filament, the conductor for the low beam filament, the high beam filament, the conductor for the high beam filament and the shield;

a portion of the cross-section of the common conductor adjacent to the shield having a flat surface; and said shield being positioned on and welded to the flat surface of the common conductor.

8. An automobile lamp bulb comprising:

a common conductor having a circular cross-section;

a low beam filament;

a conductor for the low beam filament;

a high beam filament;

a conductor for the high beam filament;

a shield disposed beside the low beam filament and welded to the common conductor;

a glass bulb containing the common conductor, the low beam filament, the conductor for the low beam filament, the high beam filament, the conductor for the high beam filament and the shield;

said shield includes a cup-like body and a tongue extending upwardly from an upper edge of the cup-like body, the tongue being provided in its upper portion with a common conductor holding groove, the common conductor being held in the common conductor holding groove; and a portion of the cross-section of the common conductor having a flat surface, and the shield is positioned on and welded to the flat surface of the common conductor.

9. An automobile lamp bulb comprising:

a common conductor having a circular cross-section;

a low beam filament;

a conductor for the low beam filament;

a high beam filament;

a conductor for the high beam filament;

a shield disposed beside the low beam filament and welded to the common conductor;

a glass bulb containing the common conductor, the low beam filament, the conductor for the low beam filament, the high beam filament, the conductor for the high beam filament and the shield;

wherein the shield includes a cup-like body and a tongue extending upwardly from an upper edge of the cup-like body, a portion of the tongue being bent towards the common conductor to form a lug, the lug is welded to the common conductor; and a portion of the cross-section of the common conductor having a flat surface and the shield is positioned on and welded to the flat surface of the common conductor.

10. An automobile lamp bulb comprising:

a common conductor;

a low beam filament;

a conductor for the low beam filament;

a high beam filament;

a conductor for the high beam filament; and a shield disposed beside the low beam filament and welded to the common conductor;

a glass bulb containing the common conductor, the low beam filament, the conductor for the low beam filament, the high beam filament, the conductor for the high beam filament and the shield;

the shield includes a cup-like body having an open end and a closed end and a tongue extending away from the open end of the cup-like body in a first direction, a portion of the tongue being bent towards the common conductor and extending in a direction generally perpendicular to the first direction to form a lug, the lug is welded to the common conductor, and the cup-like body is welded to the common conductor.

11. The automobile lamp of claim 1, wherein the shield includes a cup-like body and a tongue extending upwardly from an upper edge of the cup-like body, the common conductor being located at a spaced position from the tongue.

12. The automobile lamp bulb of claim 11, wherein the lugs are formed on the cup-like body at a spaced location from the tongue.

13. The automobile lamp bulb of claim 1, wherein the shield includes a cup-like body having an open end and a closed end, the lugs being formed on the closed end.

14. The automobile lamp bulb of claim 3, wherein the shield has an open end and a closed end, and the bent portion of the tongue extends from the open end toward the closed end.

15. The automobile lamp bulb of claim 7, wherein the shield includes a cup-like body and a tongue extending upwardly from an upper edge of the cup-like body, the common conductor being located at a spaced position from the tongue.

16. The automobile lamp bulb of claim 7, wherein the shield includes a cup-like body having an open end and a closed end, the lugs being formed on the closed end.

17. The automobile lamp bulb of claim 10, wherein the shield has an open end and a closed end, and the bent portion of the tongue extends from the open end toward the closed end.

* * * * *